US005735109A

United States Patent [19]

Kojima

[11] Patent Number: 5,735,109

[45] Date of Patent: Apr. 7, 1998

[54] SAFETY DEVICE FOR PREVENTING OVER-THE-SHOULDER FALLS FROM A HORSE

[76] Inventor: Kimberly Kojima, 2167 Green River Rd., Williamstown, Mass. 01267

[21] Appl. No.: 757,790

[22] Filed: Nov. 27, 1996

[51] Int. Cl.[6] ..... B68B 5/00

[52] U.S. Cl. ..... 54/1; 54/44.1

[58] Field of Search ..... 54/1, 4, 44.1

[56] References Cited

U.S. PATENT DOCUMENTS 3,616,595 11/1971 Townsend ..... 54/1
5,383,327 1/1995 Dohln ..... 54/44.1

FOREIGN PATENT DOCUMENTS 2552065 3/1985 France ..... 54/44.1

*Primary Examiner*—Robert P. Swiatek

[57] ABSTRACT

A safety device for preventing a rider from going over the shoulder of a horse when the horse stops suddenly, wherein the device comprises a strap tied around the body of the horse, a hollow rigid rod connected by a detaching device to the strap, and a rope retractably held within the rod and connected at one end to the waist of the rider and extendible to a first length to loosely be connected to the rider in the normal sitting position and to a second length to tightly hold the rider in a stretched position out of the saddle and over the sholder of the horse when the horse stops suddenly. The detaching device enables the rod holding the rope to move a certain range of angles to either side of a line extending from the end of the horse to the head of the horse, and when the rod travels beyond that range detaches the rod from the strap so that a rider can fall freely to the side of the horse without restraint from the rope. In the foregoing manner, the invention prevents over-the-shoulder falls, which are particularly dangerous to the head and spinal column, while allowing over the side falls which often must be done voluntarily in order to save the rider from more serious trouble.

8 Claims, 3 Drawing Sheets

SAFETY DEVICE FOR PREVENTING OVER-THE-SHOULDER FALLS FROM A HORSE

BACKGROUND OF THE INVENTION

1. Field of the Invention

This invention relates to a safety device for preventing over-the-shoulder falls from a horse when the horse stops suddenly, and more particular to such a device which also enables an unrestained fall from the side of the horse.

2. Discussion of the Prior Art

An unfortunate horse jumping accident recently pointed out the dangers connected with the equestrian sport, namely, the possibility of injuries to the head and spinal column when a rider is thrown over the shoulder of a horse when the horse stops suddenly. At present there is no reliable safety device to prevent a rider from going over the shoulder of a horse when that horse stops suddenly.

Any such device, however, must also be readily detachable for falls from the side of the horse which is called in the horse business an "emergency dismount".

There is no device in the art which has these two functions.

SUMMARY OF THE INVENTION

Accordingly, an object of the invention is to overcome the aforementioned and other deficiencies and disadvantages of the prior art.

Another object of the invention is to provide a safety device which will prevent the rider from being throw over the shoulder of the horse, such as when the horse stops suddenly.

A further object is to provide a safety device which allows the rider an amount of forward and side movement yet prevent the forward thrust over the shoulder of the horse when the horse suddenly stops.

Another objet is to provide a safety device which will become disabled when the rider is falling to the side of the horse.

DETAILED DESCRIPTION OF THE PREFERRED EMBODIMENTS

Figure 1:
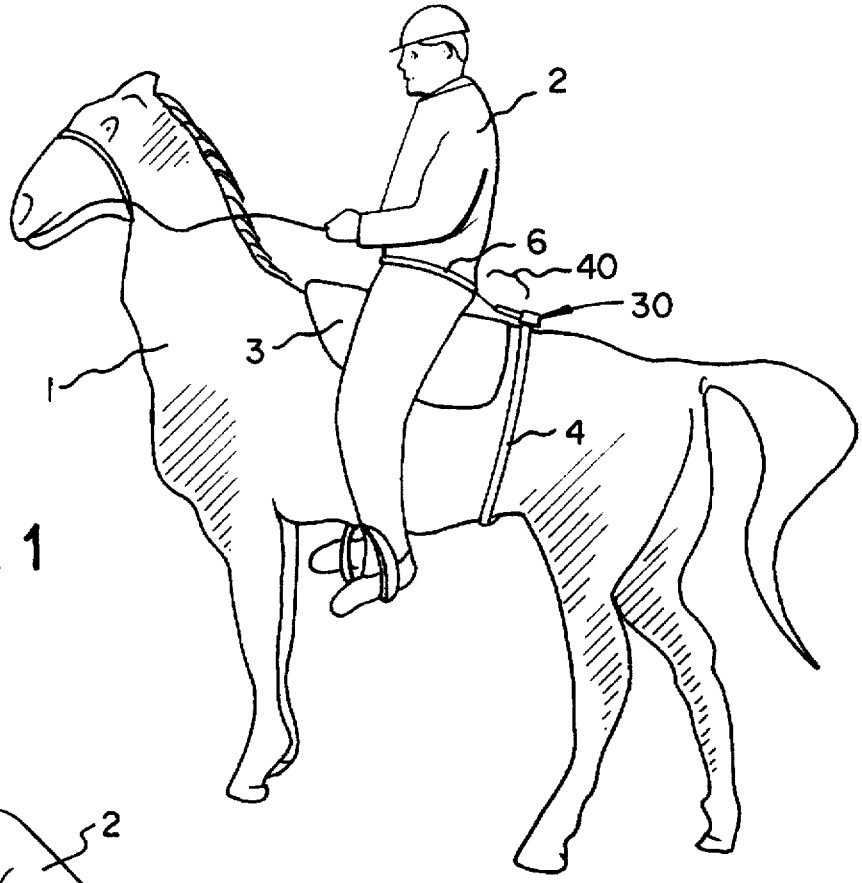
FIG. 1 is a pictorial view depicting a rider using the invention in a normal sitting position on a horse.
Figure 9:
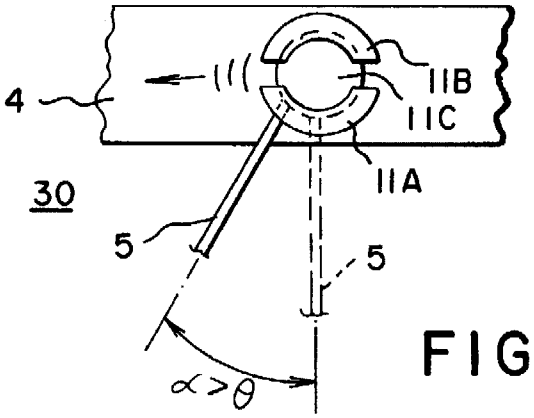
FIG. 9 is a top view of the embodiment of FIG. 8 depicting the rod being outside the permissible range of angular movement.
Figure 10:
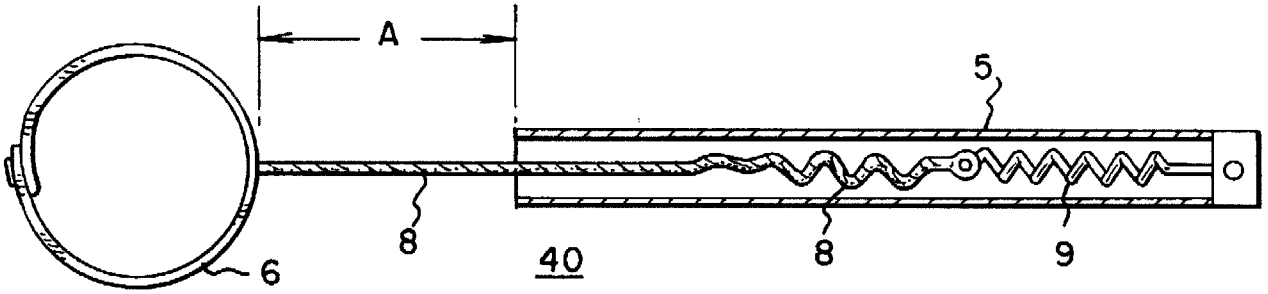
FIG. 10 is a top view depicting the extendible attaching device 40 comprising the rod, spring and rope arrangement, with the rope being extended to loosely hold the rider in the normal sitting position.
Figure 11:
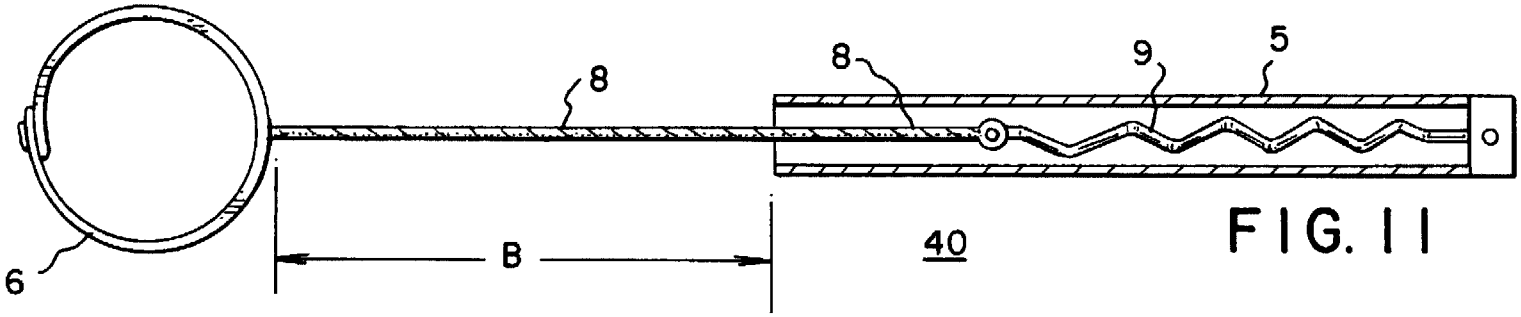
FIG. 11 is a top view depicting the embodiment of FIG. 10 with the rope being extended further to tightly hold the rider in the stretched position and preventing the riders over-the-shoulder fall.

FIG. 1 shows the safety device of the invention comprising a strap 4 wrapped and tied about the body of a horse 1 and positioned in back of a saddle 3, on which a rider 2 is shown in a normal sitting position, an extendible attaching device 40 comprising a rod 5 and a rope 8 (with a spring 9 located therein, as shown in FIGS. 10,11) which is attached to belt 6 tied about the waist of the rider 2. The same components are shown more clearly in FIG. 3, which omits the horse and rider. Also, the extendible attaching device 40 is connected to the strap 4 by a detaching means 30, which will be further explained in detail with the discussion of FIGS. 5–9.

Figure 2:
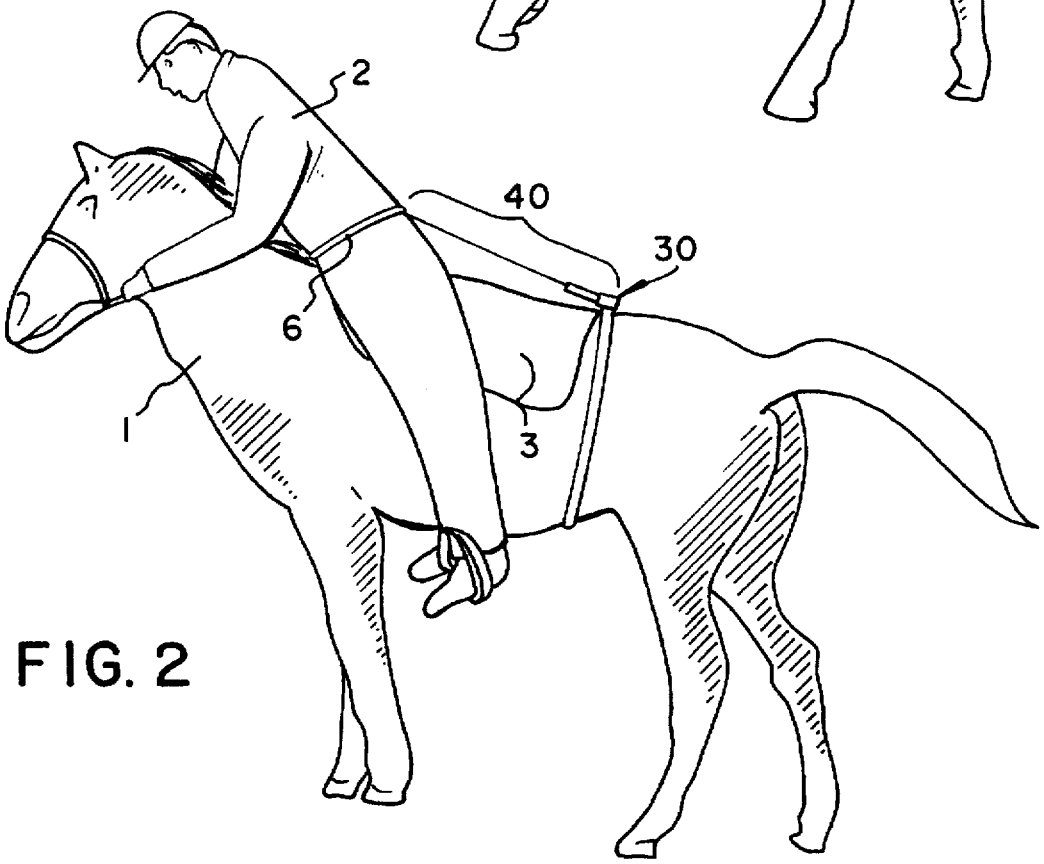
FIG. 2 is a pictorial view depicting the rider in a stretched position resulting from the horse stopping suddenly with the invention holding the rider.

FIG. 2 shows the rider 2 in the stretched position, that is leaning over the horse and out of the saddle, such as would occur when the horse 1 stops suddenly, such as when jumping a barricade but caused to be distracted. As is known, when a horse is traveling forward, the momentum also travels with the rider so that if the horse stops suddenly, the rider still has the momentum and will continue forward, and without the invention would go over the shoulder of the horse. Then, with the extendible attaching device 40 as shown in FIGS. 10 and 11, rope 8 is caused to be pulled against the resilience of the spring 9 to extend from distance or length "A" of FIG. 10, when the rider is in the sitting postion, to a distance or length "B" of FIG. 11 sufficient to hold the rider in the stretched position over the horse and to prevent the rider from going over the shoulder of the horse. The rope 8 is of a length that it will go no further than that holding the rider in the stretched position. The rod 5 to which spring 9 is attached is connected to the detaching mechanism 30 which is shown in detail in FIGS. 5–9 in two different embodiments. The detaching mechanism 30 holds the rod and rope, and consequently the rider to strap 4 which is tied to the rear body portion of the horse 1.

Turning to FIGS. 10 and 11, FIG. 10 shows extendible attaching device 40 as comprising hollow rod 5 containing therein spring 9 attached to rod 5, retractable rope 8 connected to the spring 9 and being extendible first to a length "A", which is the distance required to hold rope 8 to belt 6 when the rider 2 is in the "sitting" position, such as shown in FIG. 1. The rope 8 will be extended out to length "B" when the horse stops suddenly and the rider 2 starts to travel by momentum over the shoulder of the horse 1, such as shown in FIG. 2, to be in the stretched position. Length "B" is greater than length "A". Extendible attaching device 40 is connected to the strap 4 by a detaching device 30 so that rod 5 is held by strap 4 when rod 5 is within a certain angular range on either side of an imaginery line extending from the rear of the horse to the head of the horse.

Figure 4:
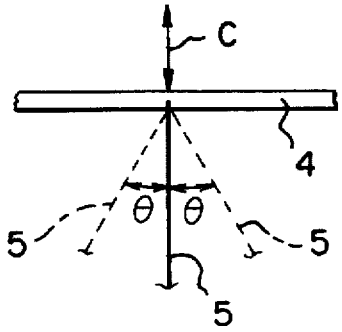
FIG. 4 is a top view depicting the permissible range of angular movement of the rod of the invention.

As shown in FIG. 4, an imaginery line (see double arrow "C") extends from the rear to the head of the horse. Rod 5 can rotate an angular distance of $\pm\theta$ without becoming detached from connection to strap 4. That is to say, when the rider is being pushed over the head and shoulder of the horse, the rope and rod will be within the permissible angular range of ±θ and rod 5 will remain connected to strap 4. On the other hand, as a concurrent safety measure, when rod 5 goes beyond that angular range, rod 5 will be detached from connection to strap 4. This will be described further in connection with FIGS. 5–9.

Figure 3:
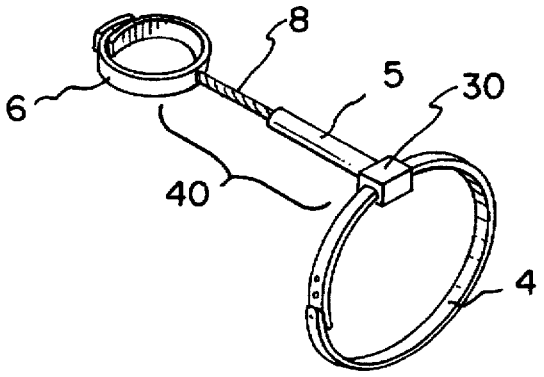
FIG. 3 is a pictorial view of an illustrative embodiment of the invention attached to a belt and without the horse and rider.

Turning to FIG. 3, the safety device of the invention is shown without the rider and horse. That is, the invention comprises an anchor means 4 (comprising a strap which may be tied to the body of the horse 1) a detaching device 30, which detachably holds extendible attaching device 40 to strap 4 and which extendible attaching device 40 is shown comprising rod 5, spring 9, and rope 8 connected to belt 6. The detachable device 30 is shown as two different embodiments in FIGS. 5–9. The extendible attaching device 40 is shown in detail in FIGS. 10, and 11, and has been described already above.

Thus, to recapitulate. In FIGS. 1–9 and 10,11, when the rider is sitting on the saddle in the normal riding position, rope 8 (of length "A" of FIG. 10) is attached to belt 6 tied about his/her waist, with rope 8 connected to spring 9, which is connected to the inside of rod 5, which rod 5 is connected via the detaching device 30 to strap 4, thereby holding loosely the rider. When the horse 1 stops suddenly, the momentum will carry the rider forward up and over the shoulder of the horse 1.and out of the saddle 3. Since rope 8 is tied to belt 6, rope 8 will be pulled out of rod 5 against the resilience of spring 9 until it reaches the maximum length "B" (see FIG. 11), when the rider 2 will stop the forward movement held by the rope, rod, detachable device, and strap. In this manner, advantageously, the rider will be prevented from falling forward over the shoulder of the horse, and any head or spinal cord injury will be substantially prevented.

As mentioned above, a side fall from the horse is not as dangerous as an over-the-shoulder fall, and in fact, in some circumstances, a fall to the side is deliberately done to avoid a more dangerous situation. In that case, it is best to not have any restraints which would tie the rider to the horse. That is to say, the rope and rod should be detached from the strap. As shown in FIG. 4, the over-the-shoulder fall type situation occurs with the rod 5 being within the permissible range of ±θ. The side fall situation occurs when the rod 5 is outside that range. In that case, detachable device 30 causes the rod 5 to become detached from the anchoring device 4 so that when the rider falls, there will be no restraining rope holding him to the horse.

Figure 5:
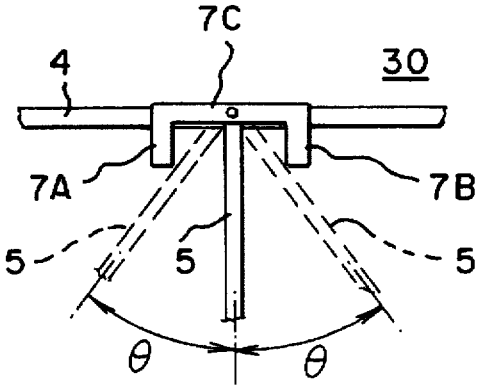
FIG. 5 is a top view depicting a detaching arrangement of the invention with the rod being within the permissible range of angular movement.
Figure 6:
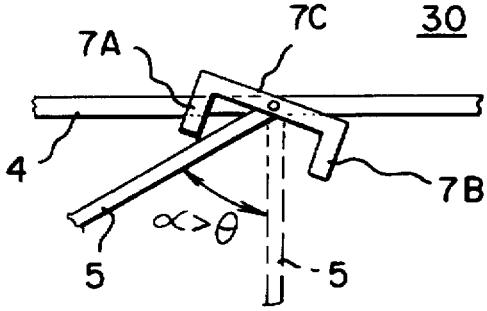
FIG. 6 is a top view of the embodiment of FIG. 5 with the rod being outside the range to cause the detachment of the rod from the anchoring strap.
Figure 7:
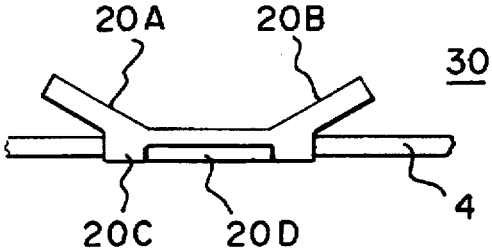
FIG. 7 is a top view depicting details of the detaching mechanism.
Figure 8:
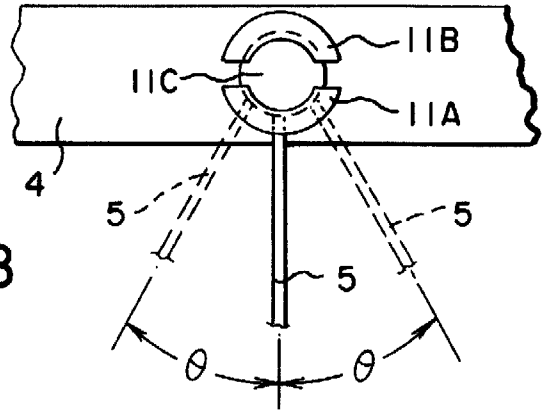
FIG. 8 is a top view depicting another detaching arrangement of the invention, with the rod being within the permissible range of angular movement.

FIGS. 5–7 show one example of a detaching device, and FIGS. 8, and 9 show another example of a detaching device. In FIG. 5, rod 5 is within the acceptable angular range of ±θ, and the rod 5 is connected to strap 4. The detaching device 30 comprises a pair of side walls 7A,7B disposed at right angles to main wall 7C. The dimensions of the walls are such that rod 5, which is attached to main wall 7C in a rotative manner, can move within the angular range ±θ without touching side walls 7A,7B. But, when rod 5 moves outside of such angular range, it will push wall 7A or 7B, as shown in FIG. 6. This causes the insert part 20D (see FIG. 7) to move from a position which is parallel to the strap 4, and within channel 20C, to either of channels 20A or 20B. The channels 20A and 20B are positioned at an angle to the slot or channel 20C and are both open at their unconnected ends, so that when insert part 20D is caused to go into such channels 20A,or 20B, which happens when rod 5 is outside the angular range of ±θ, and allows insert part 20D to slide outside the channel through the ends and thereby detach extendible part 40 having rod 5 from connection to the anchoring device 4. When the rod is within the angular range, the insert part is within channel 20C and thus rod 5 is connected with strap 4. The pulling force by rod 5 is held by the walls of channel 20c.

Another detaching device 30 is shown in FIGS. 8 and 9, wherein a pair of opposite semicircular bearings 11A and 11B hold spherical ball 11C therebetween, with ball 11C connected to rod 5, in a rigid manner. Between the bearings and opposite each other are provided openings the size of the ball, so that when the rod 5 is outside the above mentioned acceptable angular range of ±θ, the ball 11C will be caused to move outside of the bearings 11A,11B. During the time rod 5 is within the acceptable angular range, the ball will be held by the bearings, and rod 5 can be pulled by the rope against and be anchored by bearing 11A.

Thus, advantegously, with the invention, the over-the-shoulder fall is substantially prevented, and the over-the-side fall is allowed without any restraint from the rope which is detached for such situation by the detaching mechanism of the invention.

What is claimed is:

1. A safety device for preventing a rider from going over the shoulder of a horse when the horse stops suddenly, said device comprising:

anchor means for disposition toward the rear end of the horse; and extendible means attachable to said rider and to said anchor means for loosely holding said rider in a normal sitting position and for tightly holding said rider in a stretched position above said shoulder of said horse to prevent said rider from being thrown over said shoulder of said horse when said horse stops suddenly; said extendible means comprising:

a hollow rod having two ends;

a spring held in said rod at one end thereof;

a rope connected to said spring and extending out of another end of said rod, said rope being connectable to a waist of said rider, for loosely holding said rider in said normal sitting position, and for tightly holding said rider with said rope being pulled against said spring resilience to a longer length in said stretched position; and detachable means connected to said anchor means and to said one end of said hollow rod for detaching said extendible means when said rider falls off the side of said horse.

2. The device of claim 1, wherein said rod is normally in an imaginery line extending from said rear end to said head of said horse, and is movable within a range of angles to either side of said imaginery line.

3. The deuce of claim 2, wherein said detaching means comprises: a frame having two side walls, said rod being disposed between said two side walls so that said rod has a permissible movement within said range of angles to either side of said imaginery line, and so that when said rod goes beyond said range of angles said rod causes either of said two side walls to move and thereby cause detachment of said rod from said anchor means.

4. The device of claim 3, wherein said frame comprises an insert part, a first channel positioned perpendicular to said imaginery line, and two channels having an open end and angularly disposed with respect to said first channel, whereby when said rod is within said range of angles, said insert part is within said first channel to hold said rod to said anchor/means and when said rod is outside of said range of angles, said rod will cause one of said two side walls to move said insert part to one of said two channels and cause said insert part to move out of said open end thereof thereby to detach the rod from said anchor means.

5. The device of claim 2, wherein said detaching means comprises a semi-circular bearing having an opening on two sides thereof, and a ball connected to said rod and disposed within said bearing, whereby when said rod is within said range of angles said ball will be held by said bearing and when said rod is outside of said range of angles, said ball will be caused to move out of said opening and cause said rod to become detached from said anchor means.

6. The device of claim 2, wherein said range of angles is ±15°.

7. The device of claim 1, wherein said anchor means comprises a strap securable around the body of said horse.

8. The device of claim 1, further comprising a belt capable of being tied around a waist of said rider, and means for attaching said rope to said belt.

* * * * *